US007439931B1

(12) United States Patent
Fan

(10) Patent No.: US 7,439,931 B1
(45) Date of Patent: Oct. 21, 2008

(54) ATTACHMENT RACK APPARATUS WITH ANTENNA

(76) Inventor: Eagle Fan, No. 133, Cheng-Kung 6 St., Chu-Pei City, Hsinchu (TW)

( * ) Notice: Subject to any disclaimer, the term of this patent is extended or adjusted under 35 U.S.C. 154(b) by 0 days.

(21) Appl. No.: 11/850,679

(22) Filed: Sep. 6, 2007

(51) Int. Cl.
*H01Q 1/14* (2006.01)

(52) U.S. Cl. ..... 343/878; 343/713; 343/715; 343/873; 343/905

(58) Field of Classification Search ..... 343/713, 343/715, 873, 882, 878, 880, 905
See application file for complete search history.

(56) References Cited

U.S. PATENT DOCUMENTS 6,853,340 B2 * 2/2005 Wang ..... 343/715
2007/0249412 A1 * 10/2007 Fan et al. ..... 455/569.2

* cited by examiner

*Primary Examiner*—Lincoln Donovan
*Assistant Examiner*—Chuc Tran

(57) ABSTRACT

An attachment rack apparatus with antenna is provided, including a first connection unit, a second connection unit and an antenna unit. The first connection unit includes a first attachment plate and a second attachment plate. One end of the first and second attachment plates are connected together. The two attachment plates are arcs facing each other to form a non-closed space. The bottom of the second connection unit is attached to the joint of the first and the second attachment plates. The top of the second connection unit is attached to the antenna unit. The second connection unit provides the antenna unit with space and mechanism for adjustment in angles, positions and orientations. The present invention is applicable to a holder with suction disc for holding electronic devices in a vehicle.

8 Claims, 6 Drawing Sheets

ATTACHMENT RACK APPARATUS WITH ANTENNA

FIELD OF THE INVENTION

The present invention generally relates to an attachment rack apparatus with antenna, and more specifically to a design applicable to using with wireless communication device holder with suction disc used in vehicle.

BACKGROUND OF THE INVENTION

A wide range of portable electronic devices are becoming a part of the modern daily life for most people, such as mobile phones, audiovisual player, PDA, GPS, digital TV, and so on. These electronic devices are also used in vehicles. However, as most of the electronic devices are not standard options to the majority of the vehicles, the driver usually needs an additional holder to hold the electronic devices in place so that the use of these electronic devices will not interfere with the driving. One popular design of the holder is using suction disc, or sucker. The holder with sucker usually includes a suction disc apparatus, a supportive frame, and a clapping holding part. The supportive frame is connected to suction disc apparatus and the clipping holder part. When in use, the suction disc apparatus is attached to the glass of the vehicle, such as windshield, the supportive frame is adjustable to provide convenient positions, and the clipping holding part is to hold the electronic device.

Many of the electronic devices used in the vehicle come with an antenna set for providing better reception for wireless communication devices, such as GPS, DTV, and so on. However, the design of the convention holder with sucker usually does not provide additional holder to the antenna set of these wireless communication devices. Therefore, some antenna set is attached to the ceiling by a magnet. Alternatively, additional conductive wire is used to connect the antenna set placed on the dash board close to the windshield. With the limited space in the vehicle, the additional wires for antenna set is not only in convenient, but also dangerous to interfere with the driving. In addition, when different electronic devices are held by the holder, different antenna sets must be used. The removal and replacement of the antenna set is an additional inconvenience.

Because the holder with sucker is popular and widely used in vehicles, it would provide great convenience to the users with an attachment design with an antenna that can be attached to the holder with sucker so that the installation of an additional antenna set to the existing holder with sucker is easy.

SUMMARY OF THE INVENTION

The primary object of the present invention is to provide an attachment rack apparatus with antenna, for using with the holder with suction disc used in vehicle. When the driver uses the holder to hold the wireless communication device, the present invention can be used to accommodate the wireless communication device, and the antenna of the present invention can be used for signal reception to eliminate the scattered additional wires.

To achieve the above object, the present invention provides an attachment rack apparatus with antenna, including a first connection unit, a second connection unit and an antenna unit. The first connection unit includes a first attachment plate and a second attachment plate. One end of the first and second attachment plates are connected together. The two attachment plates are arcs facing each other to form a non-closed space. The bottom of the second connection unit is attached to the joint of the first and the second attachment plates. The top of the second connection unit is attached to the antenna unit. The second connection unit provides the antenna unit with space and mechanism for adjustment in angles, positions and orientations. The antenna unit includes an antenna part and a connection wire. One end of the connection wire is connected to the antenna part and the other end is connected to the electronic device in use.

When the attachment rack apparatus with antenna of the present invention is in use, the first and second attachment plates of the first connection unit are used to attach to the suction holder. The location of attachment is between the base seat and the soft suction disc at the bottom of the suction holder. More specifically, the location is at the place on the suction disc close to the rim of the suction disc and close to the rim of the base seat. The second connection unit is connected between the first connection unit and the antenna unit so that the antenna unit is adjustable to angles, positions and orientations because the antenna must be adjustable t prevent from being shield to affect the reception when in use.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
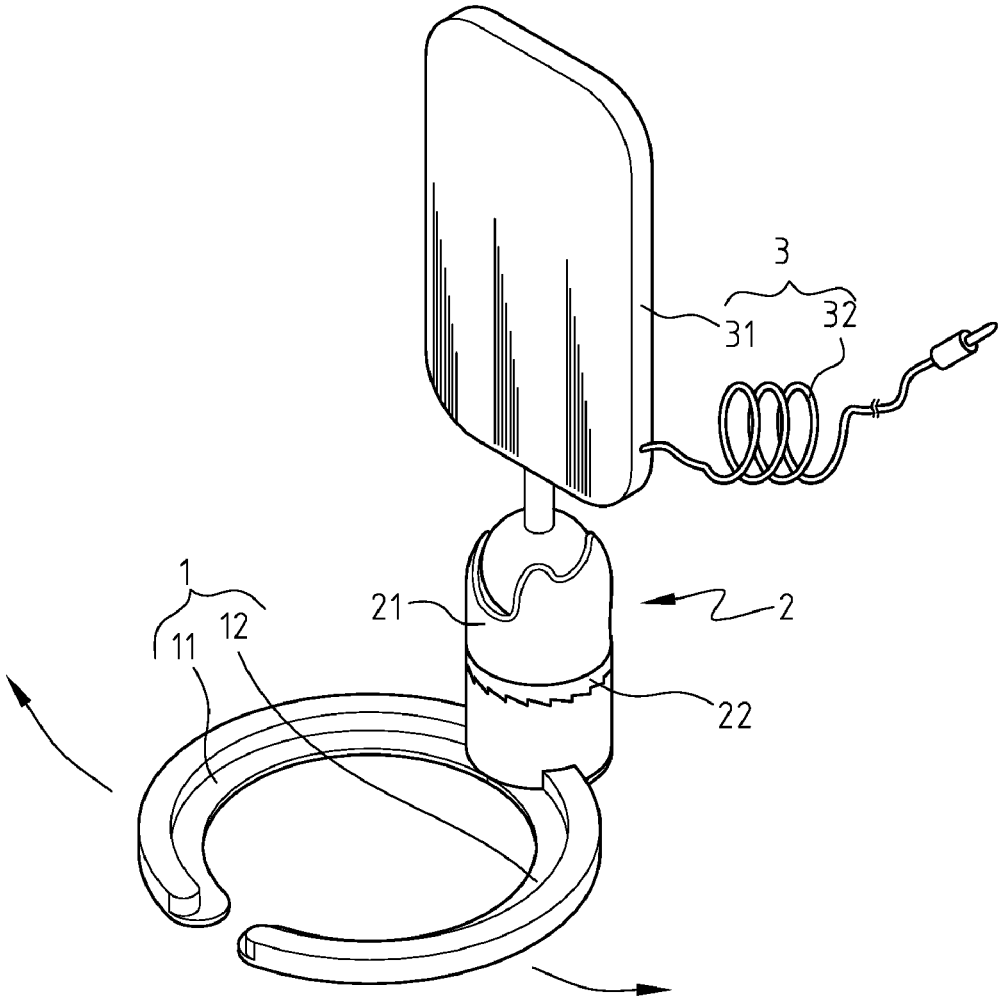
FIG. 1 shows a three-dimensional schematic view of the present invention.

FIG. 1 shows a schematic view of the present invention. An attachment rack apparatus with antenna of the present invention includes a first connection unit 1, a second connection unit 2 and an antenna unit 3. First connection unit 1 further includes a first attachment plate 11 and a second attachment plate 12. One end of first attachment plate 11 is connected to one end of second attachment plate. First attachment plate 11 and second attachment plate 12 are arcs facing each other and forming a non-closed space, similar to two open arms. The bottom of second connection unit 2 is attached to the joint of first attachment plate 11 and second attachment plate 12, and the top of second connection unit 2 is connected to antenna unit 3. Antenna unit 3 further includes an antenna part 31 and a connection wire 32. One end of connection wire 32 is connected to antenna part 31, and the other end is connected to the electronic device in use. Second connection unit 2 allows antenna unit 3 to adjust for different angles, positions and orientations.

In the present embodiment, first attachment plate 31 and second attachment plate 32 of first connection unit 1 can move to open or close for convenience of clipping. On the other hand, first attachment plate 31 and second attachment plate 32 of first connection unit 1 can also be fixed and non-moveable. In this case, the non-closed space formed between first attachment plate 31 and second attachment plate 2 must be larger, for example, ½-⅔ of the circumference.

Figure 2:
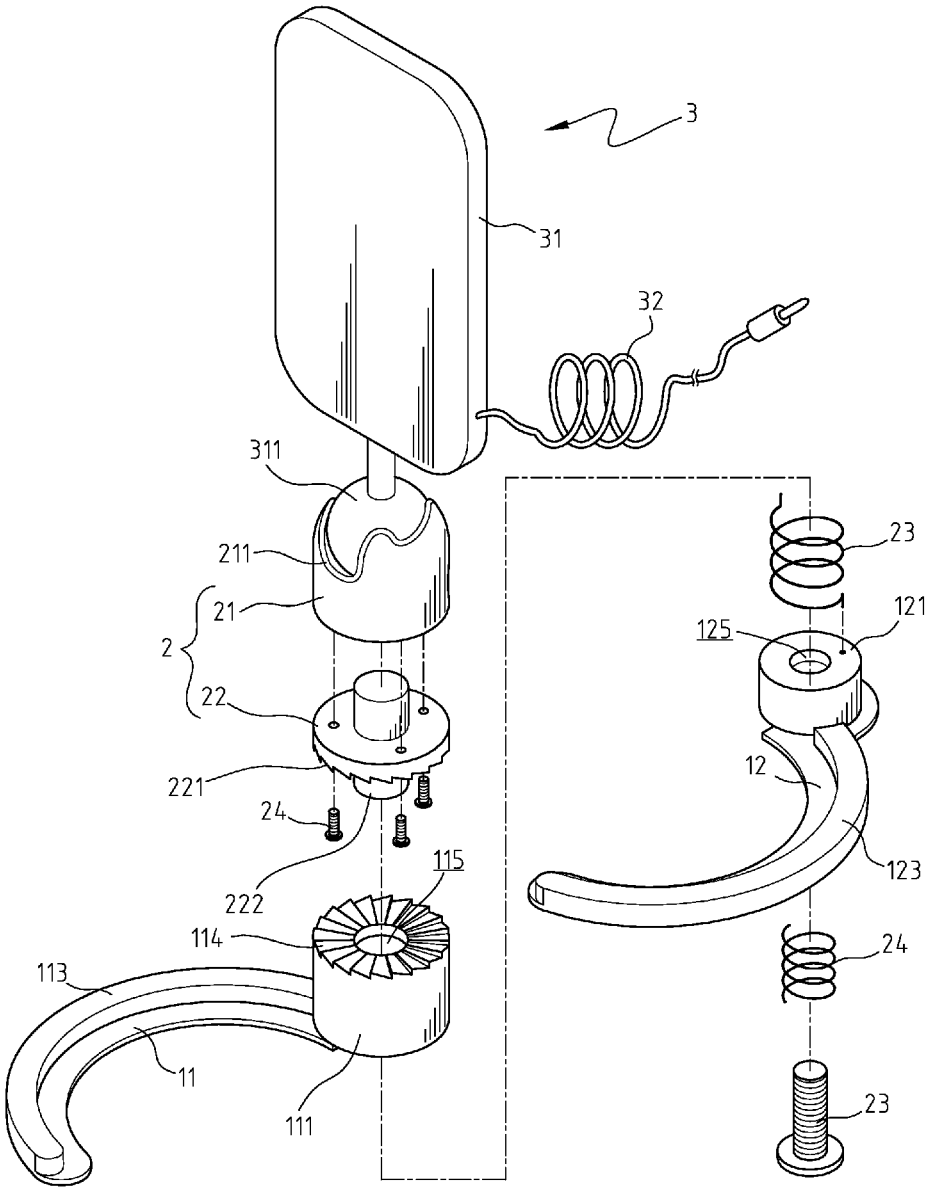
FIG. 2 shows a dissected view of the present invention.
Figure 3:
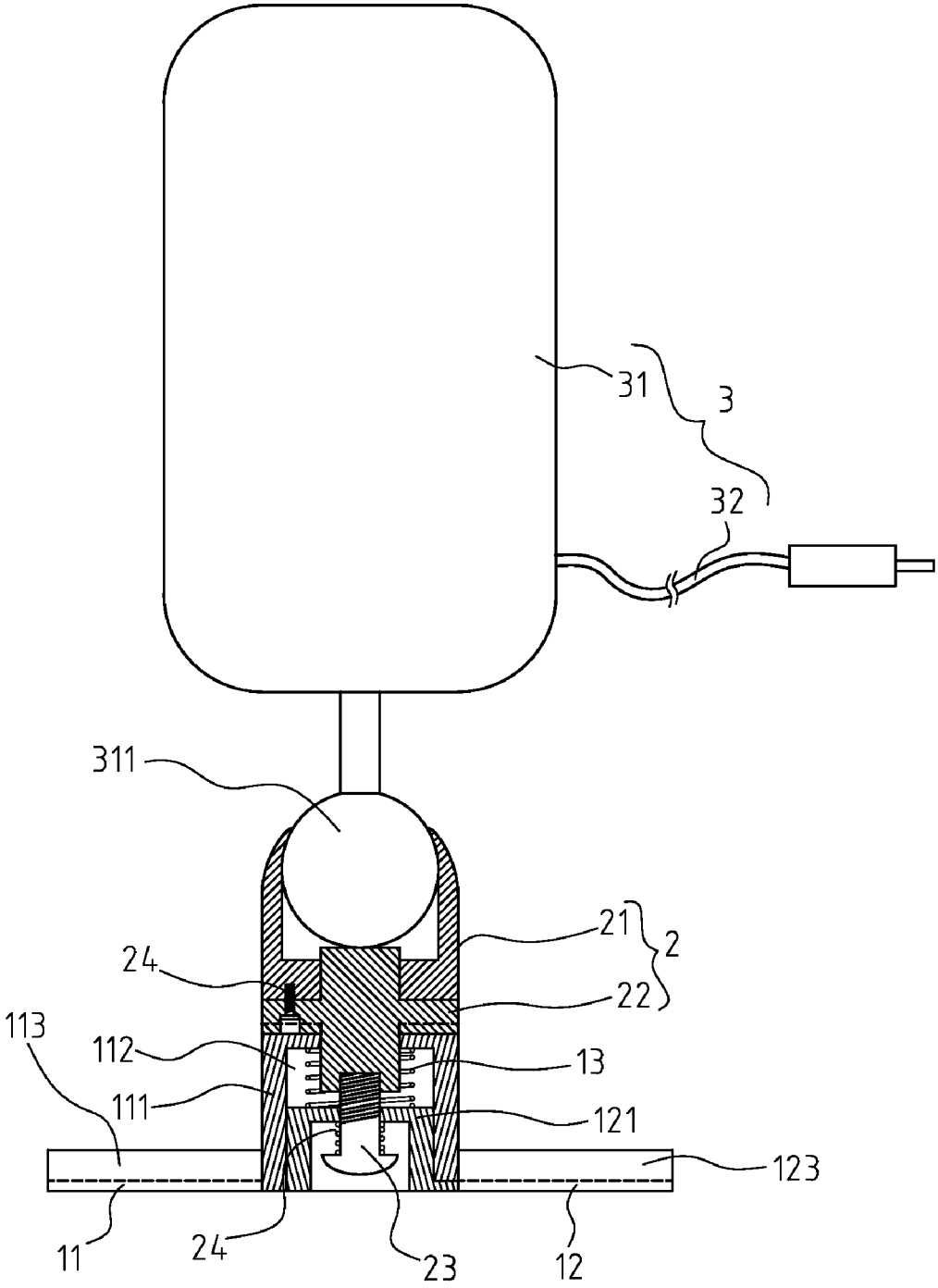
FIG. 3 shows a cross-sectional view of the present invention.

FIGS. 2 & 3 show the dissected and cross-sectional views of the present invention, respectively. As shown in FIGS. 2&3, first connection unit includes first attachment plate 11 and second attachment plate 12. One end of first attachment plate 11 is connected to one end of second attachment plate 12. The connection is a coupling. The connection mechanism includes a first coupling part 111, a second coupling part 121 and a flexible element 13. First coupling part 111 is located at one end of first attachment plate 11, and has the shape of a protruding cylinder with an interior round axial hole 112. Second coupling part 121 is located at one end of second attachment plate 12, and has the shape of cylinder with smaller diameter. Second coupling part 121 is placed inside interior round axial hole 112 of first coupling part 111. Because the height of second coupling part 121 is shorter than the height of round axial hole 112, flexible element 13 can be placed on top of second coupling part 121 inside round axial hole 112. Flexible element 13 is a spring button, with two ends fixed to the tope of second coupling part and the inner wall of first coupling part 111, respectively. Flexible element 13 provides the automatic recovery capability when first attachment plate 11 and second attachment plate 12 are open. The outer rim of first attachment plate 11 and second attachment plate 12 has an arc stopping plate 113, 123, respectively.

Second connection unit 2 provides the angle, position and orientation adjustability of antenna unit 3. The structure of connection unit 2 can be various types of linkage or adjustable mechanisms. The present embodiment only provides one way of implementation, while other equivalent mechanisms can also be used. Second connection unit 2 includes a ball seat 21, a rotating disc 22, and a screw 23. Ball seat 21 is fixed to the top of rotating disc 22. In the present embodiment, a small screw 24 is used to fasten ball seat 21 and rotating disc 22, but glue or other methods can also be used. The bottom of antenna part 31 of antenna unit 3 is an attachment part 311. The shape of attachment part 311 is a ball. Attachment part 311 is placed in ball seat 21 so that antenna part 31 attached to attachment part 311 can perform maximum adjustment. Ball seat 21 also includes an opening 211. The bottom of rotating disc 23 is attached by crew 23 to the joint of first attachment plate 11 and second attachment plate 12 of first connection unit 1, and rotating disc 22 can rotate.

To hold rotating disc 22 after rotation in place, the structure includes special designs. The bottom of rotating disc 22 includes teeth surface 221, and the center of the bottom has an extended axis 222. The top of first coupling part 111 also includes a teeth part 114. The central areas of first coupling part 111 and second coupling 112 have a hole 115, 125, respectively. Holes 115, 125 have different diameters. The shape of teeth surface 221 and teeth part 114 are complementary. When assembled, axis 222 of rotating disc 22 passes hole 115 of first coupling part 111, and screw 23 passes upwards from hole 125 of second coupling part 121 to be fastened to the bottom of axis 222. The outside of screw 23 includes a spring 24, stuck inside second coupling part 121. With such, when rotating disc 22 rotates, rotating disc 22 will move upwards slightly due to the teeth surface.

Figure 4:
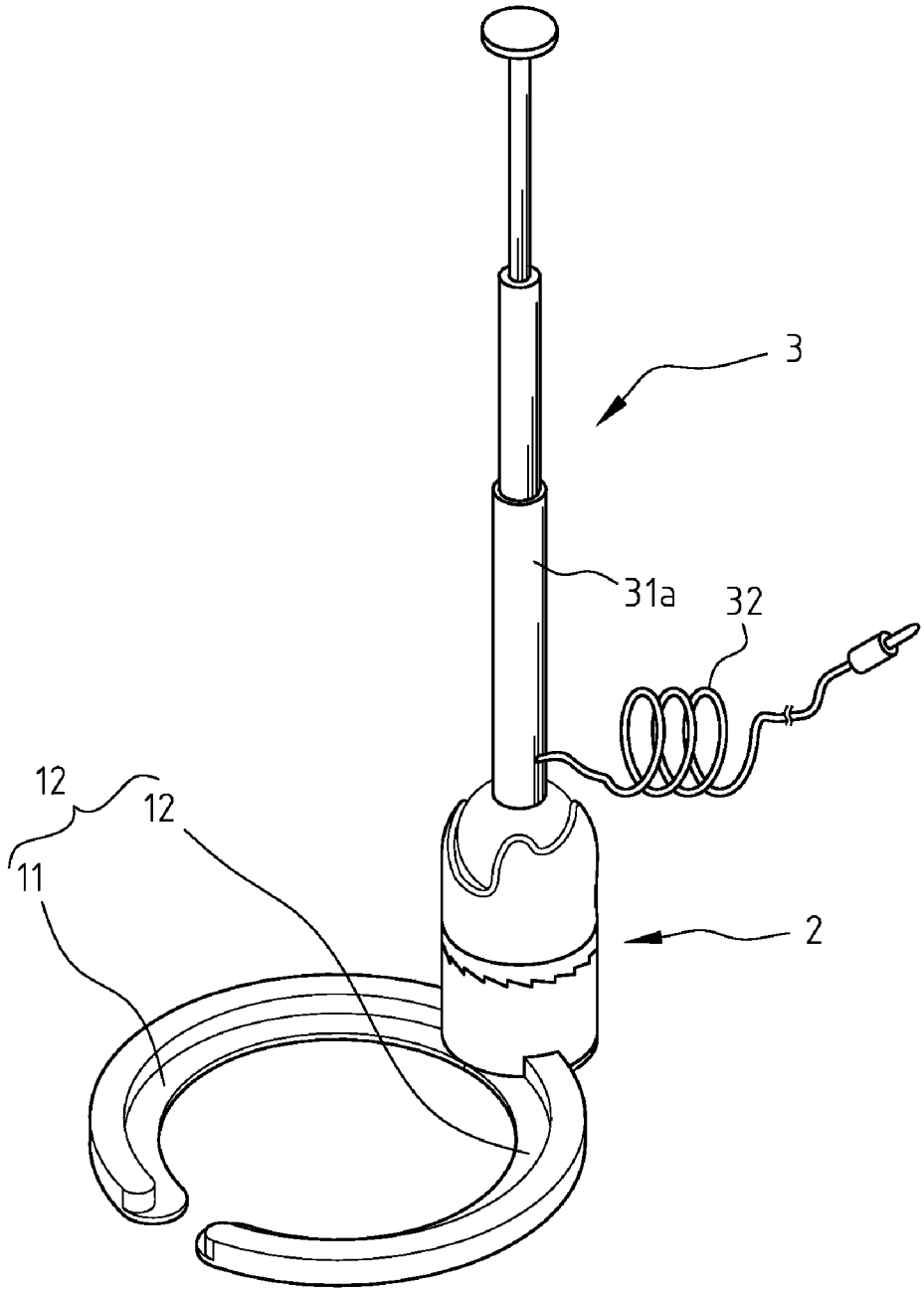
FIG. 4 shows a schematic view of another embodiment of the present invention.

Antenna unit 3 includes antenna part 31 and connection wire 32. Antenna part 31 is an antenna loop hidden inside, and the circuit design of antenna part 31 matches the type of signal, such as satellite, DTV, or broadcasting signals. FIG. 4 shows the second embodiment of the present invention. As shown in FIG. 4, antenna part 31*a* is an extendible antenna. Antenna part 31 is not limited to any specific type of antenna. Antenna unit 3 is designed to match the corresponding electronic device.

Figure 5:
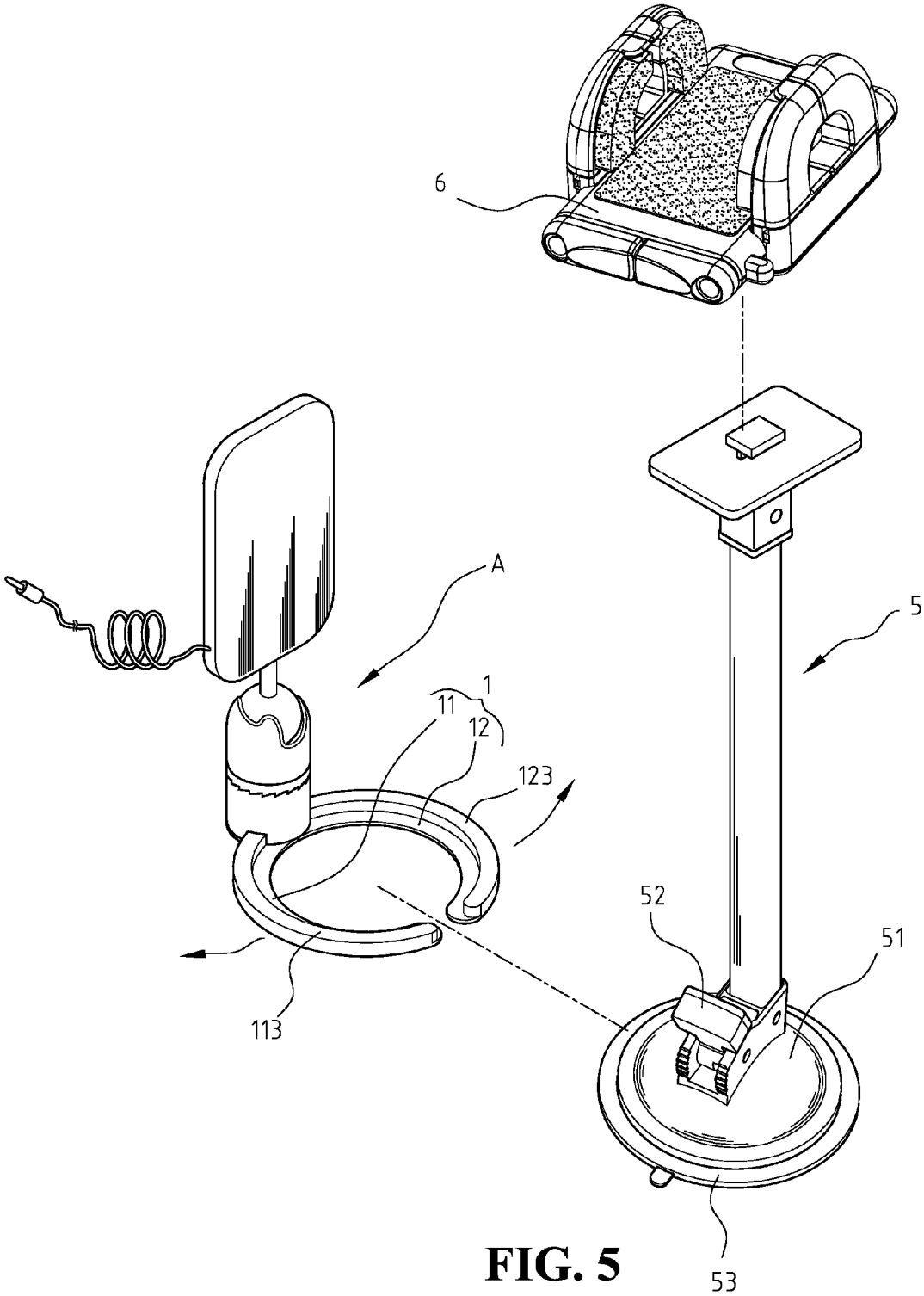
FIG. 5 shows a dissected view of the present invention in actual application.
Figure 6:
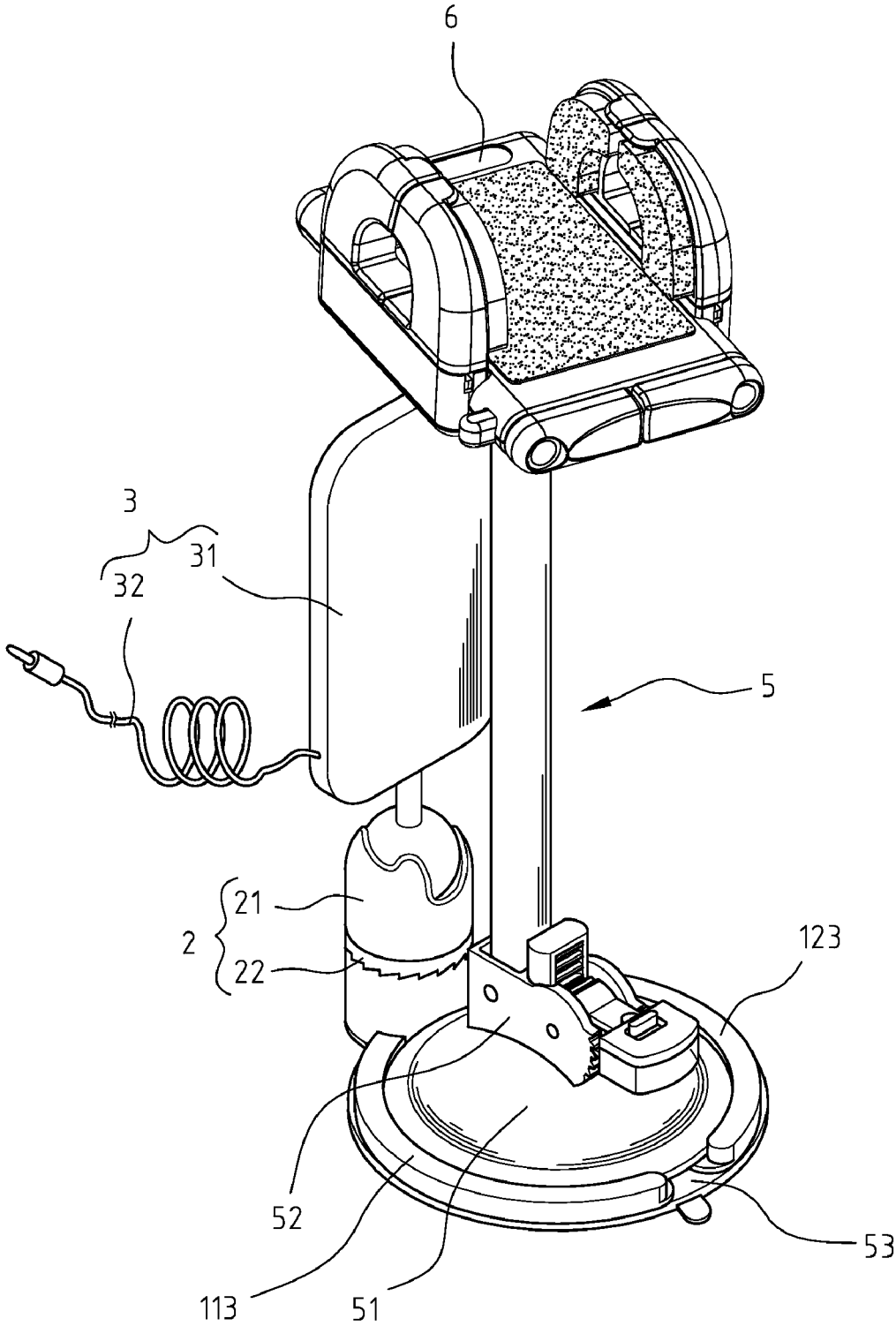
FIG. 6 shows a cross-sectional view of the present invention in actual application.

FIGS. 5 & 6 show the dissected and cross-sectional views of the actual application of the present invention. An attachment rack apparatus with antenna A of the present invention can be used to clip to a suction holder 5 used in a vehicle. The top of suction holder 5 includes a clipping holding part 6 for holding an electronic device. The bottom of suction holder 5 includes a base seat 51, a wrench unit 52, and a soft suction disc 53. Wrench unit 52 include a plurality of elements distributed across the interior or the top of base seat 51. By pushing wrench unit 52, the bottom if base seat 51 will press the rim of soft suction disc 53 against the windshield, in the mean time, wrench unit 52 pulls the center of soft suction disc 52 from the inside of base seat 51 so that the negative pressure will form at the center of soft suction disc 53. Therefore, suction disc 53 will attach to windshield.

Before soft suction disc 53 is attached to the windshield, suction disc 53 is not tightly attached to base seat 51. At this point, first connection unit 1 of attachment rack apparatus A with antenna of the present invention is attached to base seat 51 by pulling first attachment plate 11 and second attachment plate 12 apart, and inserting first attachment plate 11 and second attachment plate 12 between base seat 51 and suction disc 53. because of stopping plates 113, 123, when the pulling force is no longer exerted on, first attachment plate 11 and second attachment plate 12 will clip on the rim of base seat 51, and first attachment plate 11 and second attachment plate 12 will extend underneath base seat near the rim. As shown in FIG. 6, when wrench unit 52 is operated, base seat 51 presses the top of first attachment plate 11 and second attachment plate 12, and first attachment plate 11 and second attachment plate 12 press the top of the rim of suction disc 53 so that base seat 51, first attachment plate 11 and second attachment plate 12, and suction disc 53 are tightly attached to each other. In the mean time, the center of suction disc 53 is pulled up by wrench unit 52 to form suction to the windshield.

When in use, the wireless communication device, such as GPS can be held by clipping holding part 6, and connected to antenna unit 3 through connection wire 32. Ball seat 21 of second connection unit 2 can be used to adjust the angle and orientation of antenna part 31, In addition, rotating disc 22 can be used to change the position of antenna part 31 so that antenna unit 3 can receive the signal at the maximum effect.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An attachment rack apparatus with antenna, applicable to holder with suction disc used in vehicle to hold electronic devices, said apparatus comprising:

a first connection unit, further comprising a first attachment plate and a second attachment plate, said first attachment plate and said second attachment plate being arcs facing each other to from a non-closed space, one end of said first attachment plate connected to one end of said second attachment plate;

a second connection unit, having bottom connected to the joint of said first attachment plate and said second attachment plate; and an antenna unit, connected to the top of said second connection unit, further comprising an antenna part and a connection wire, one end of said connection wire connected to said antenna part, and the other end connected to an electronic device.

2. The apparatus as claimed in claim 1, wherein said second connection unit allows said antenna unit for three-dimensional angle adjustment.

3. The apparatus as claimed in claim 1, wherein said first attachment plate and said second attachment plate of said first connection unit are connected by a structure comprising a first coupling part, a second coupling part, and a flexible element; said first coupling part is located on one end of said first attachment plate with an interior round axial hole, said second coupling part is located on one end of said second attachment plate, and is placed inside said round axial hole of said first coupling part, and two ends of said flexible element are connected to said first coupling part and said second coupling part respectively to provide flexibility of automatic recovery after said two attachment plates open apart.

4. The apparatus as claimed in claim 1, wherein said second connection unit further comprises a ball seat, a rotating disc, and a screw; said rotating disc is fixed to the bottom of said ball seat, said rotating disc uses a screw to attach to the joint of said first attachment plate and said second attachment plate of said first connection unit; said rotating disc can rotate, and the bottom of said antenna part of said antenna unit has a ball-shaped attachment part, and said attachment part is placed in said ball seat.

5. The apparatus as claimed in claim 1, wherein the top of said first coupling part of said first attachment plate comprises a teeth surface, the bottom of said rotating disc of said second connection unit also comprises a teeth part connected to said teeth surface of the top of said first coupling part, said rotating disc has an axis extending downward, said axis passes a hole of said first coupling part, said screw passes upwards a hole of said second coupling part to fasten at the bottom of said axis, an additional spring is located at the bottom of said coupling part, stuck on the outside of said screw so that said rotating disc of said second connection unit can move slightly upward when rotating.

6. The apparatus as claimed in claim 1, wherein said antenna part of said antenna unit comprises a hidden antenna loop.

7. The apparatus as claimed in claim 1, wherein said antenna unit is an extendible antenna.

8. The apparatus as claimed in claim 1, wherein the outer rims of said first attachment plate and said second attachment plate have an arc stopping plate respectively.

* * * * *